US007704167B1

(12) United States Patent
Lopez

(10) Patent No.: US 7,704,167 B1
(45) Date of Patent: Apr. 27, 2010

(54) ACCURATE PUTTING DEVICE

(76) Inventor: John Lopez, 521 Permont Ave. #402, Rivervale, NJ (US) 07675

( * ) Notice: Subject to any disclaimer, the term of this patent is extended or adjusted under 35 U.S.C. 154(b) by 84 days.

(21) Appl. No.: 12/115,915

(22) Filed: May 6, 2008

Related U.S. Application Data

(60) Provisional application No. 61/030,641, filed on Feb. 22, 2008.

(51) Int. Cl.
*A63B 69/36* (2006.01)

(52) U.S. Cl. ..... 473/407; 473/404

(58) Field of Classification Search ..... 473/131, 473/286, 404, 407; 33/228, 367, 369, 370, 33/377, 379, 389
See application file for complete search history.

(56) References Cited

U.S. PATENT DOCUMENTS 4,459,778 A * 7/1984 Ball ..... 49/64
4,515,201 A * 5/1985 Anderson ..... 160/174 R
5,294,110 A * 3/1994 Jenkins et al. ..... 473/407
5,662,154 A * 9/1997 Drake, III ..... 160/176.1 R
5,662,535 A * 9/1997 Smith ..... 473/404
6,770,000 B2 * 8/2004 Shelley ..... 473/404
6,997,823 B2 * 2/2006 Garza ..... 473/407

* cited by examiner

*Primary Examiner*—Nini Legesse
(74) *Attorney, Agent, or Firm*—Richard A Joel

(57) ABSTRACT

An accurate putter device comprises a frame having a pair of blinds slidable within an aperture in the frame. A thumb dial mounted on each side of the frame controls a particular blind to narrow the golfer's line of sign through the aperture so that the golfer may line-up the putt and read the grade or angle of the green towards the hole. The thumb dials are coupled to the threads running through the blinds to move the blinds to and fro along tracks in the frame to line-up the ball with respect to the hole.

9 Claims, 1 Drawing Sheet

FIG. 1
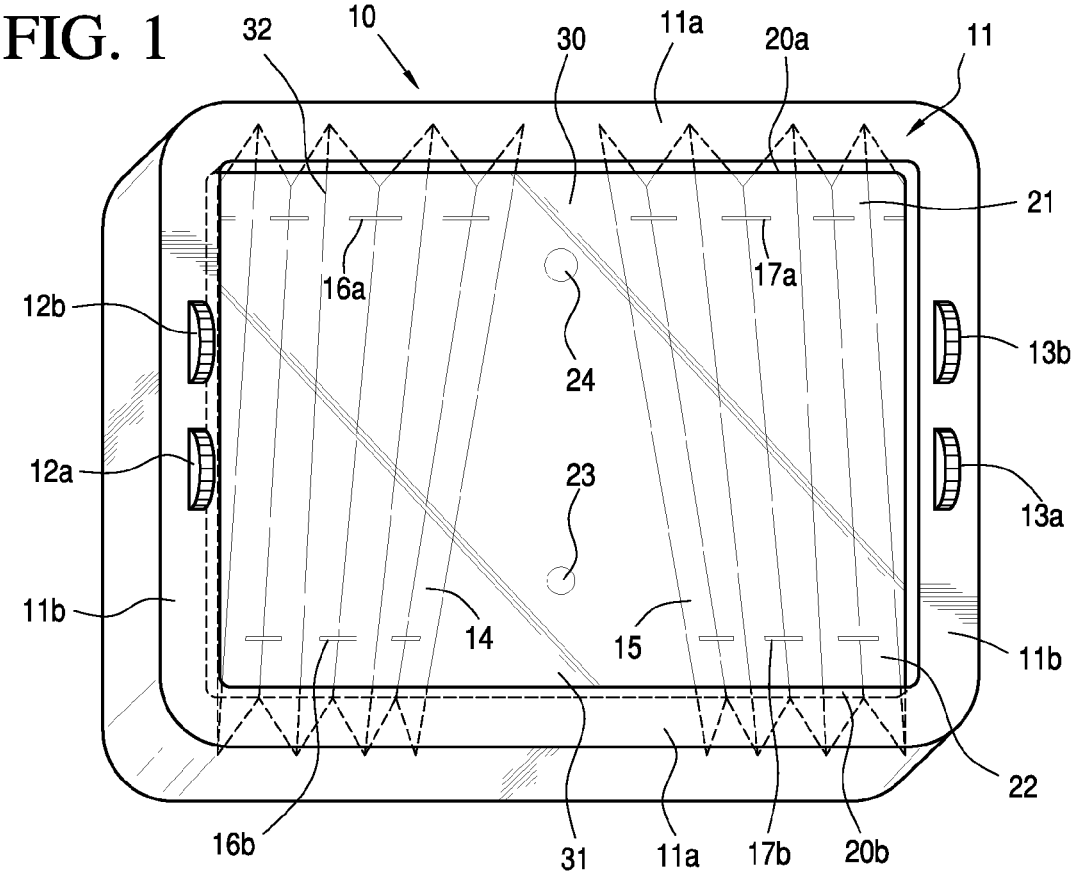
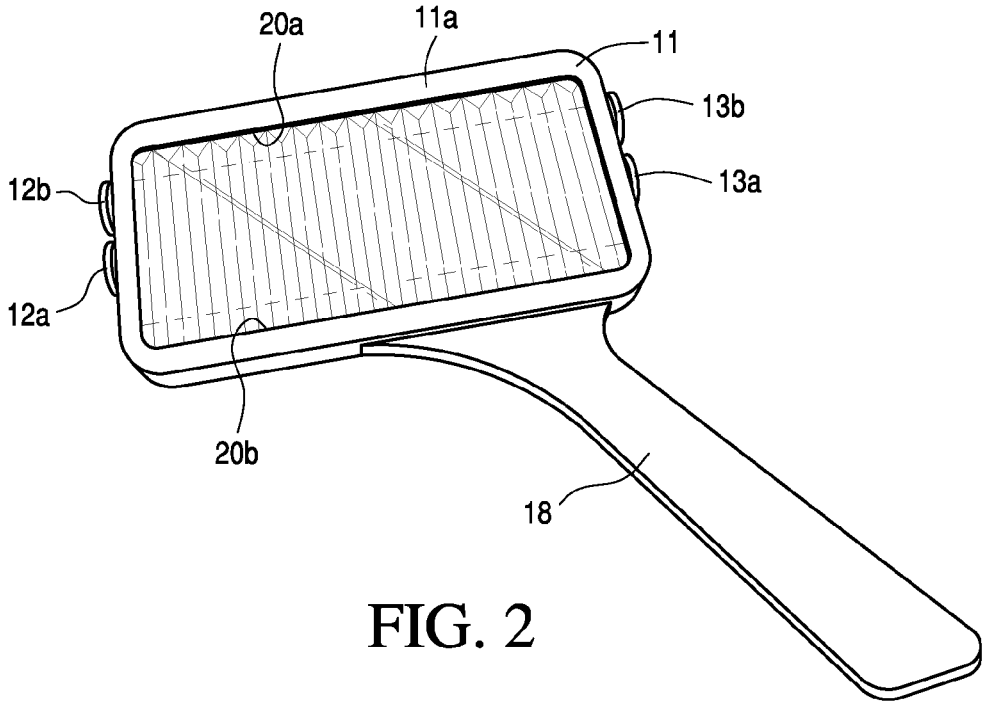
FIG. 2

ACCURATE PUTTING DEVICE

This non-provisional application is based on applicant's provisional application Ser. No. 61/030,641 filed Feb. 22, 2008.

This novel invention relates to golfing accessories and particularly to a putting device which helps the player line up the putt and read the grade or angle of the green toward the hole.

Most golfers would agree that putting is the most difficult and frustrating part of the game. Many golfers spend time aligning a putt by eyeing the line across the green toward the hole from where the ball lies. Some utilize the putter as a plumb bob tool to help determine accuracy in alignment. Without a good read of the direction that the hole was cut and also the way the blades of grass are pointing, a golfer's performance could suffer.

Successful putting requires mechanics, concentration, and ability to align the putt and read the green. The present device assists the golfer with the last of these requirements, to align the putt and read the green. The invention will also help align the angle at which the hole is located when it was cut, enabling the player to see what angle the ball would travel up to the hole. This device will eliminate the need to align putts with a putter as a plumb bob.

The prior art discloses other devices designed for aligning a golf putt, but those devices can be: cumbersome such as that disclosed by U.S. Pat. No. 6,770,000 to Shelley; distracting such as those devices disclosed by U.S. Pat. No. 4,696,111 to Gardner, U.S. Pat. No. 6,505,931 to Goldblatt, U.S. Pat. No. 6,558,266 to McMahon, U.S. Pat. No. 4,991,849 to Fabanich; or overly complicated such as those devices disclosed by U.S. Pat. No. 5,792,015 to Hoyt et al., U.S. Pat. No. 6,997,823, to Garza, and U.S. Pat. No. 4,260,151 to Weaver. The present invention discloses a lightweight, easy-to-use and portable device which helps golfers to align a putt and read the green.

The present invention relates to golfing accessories and particularly to an inexpensive putting device which helps the player line up the putt and read the grade or angle of the green toward the hole. The invention is made for placement over the eyes in order to permit a line of sight that is easy to follow. The golfer simply holds the putting device in place in front of the face and adjusts the movable blinds until a line of sight is established, as needed. A thumb dial on each side of the face is made to move the vertical blinds toward and away from the center of the unit. Each blind, one on the left side and one on the right side, can be moved individually, as desired. Adjustments can be made every time a putt is attempted. The handy lightweight unit can be made of durable materials and in sizes to suit a variety of golfers.

Accordingly, an object of this invention is to provide a new and improved putting device to improve the accuracy of putts by a golfer.

Another object of this invention is to provide a new and improved device to permit a golfer to line up their ball with the hole and read the green for putting.

A further object of this invention is to provide an inexpensive portable device which permits lining up putts through a variable aperture to eliminate distractions and improve a golfer's accuracy.

A more specific object of this invention is a new and improved device with an aperture adjusted by variable blinds controlled by dials to focus on a hole for putting.

The above and other objects and advantages of the present invention may be more clearly seen when viewed in conjunction with the accompanying drawings wherein:

FIG. 1 is a perspective view of the present invention.

FIG. 2 is a perspective view of an alternate embodiment of the present invention.

The present invention relates to golfing accessories and particularly to a putting device which helps the player line up the putt and read the grade or angle of the green toward the hole. The invention is designed to be placed in front the golfer's eyes to permit a line of sight that is easy to follow. The golfer simply holds the invention in front of his face and adjusts the settings until a line of sight is established as needed.

Referring now to the drawings, FIG. 1 discloses a perspective view of the present invention. The invention 10 includes a substantially rectangular frame 11 having parallel horizontal sides 11*a* and parallel vertical sides 11*b* forming an aperture 30 within the frame 11. Mounted within each parallel vertical side 11*b* are thumb dials 12*a*, 12*b* and 13*a*, 13*b* that cause blinds 14 and 15 to extend or compress as desired by the user. The thumb dials 12*a*, 12*b* and 13*a* 13*b* communicate with the blinds 14 and 15 by threads 16*a*, 16*b* and 17*a*, 17*b* as well. The threads 16*a* and 17*a* run across the top portion while threads 16*b* and 17*b* run across the bottom portion of blinds 14 and 15, along the interior of the parallel vertical sides 11*b* and are coupled to the thumb dials 12*a*, 12*b* and 13*a*, 13*b*. This allows the thumb dials 12*a*, 12*b* and 13*a*, 13*b* when rotated, to cause the blinds 14 and 15 to extend or compress. The blinds 14 and 15 include angular or pointed end portions 32 which are guided in the interior grooves 20*a* and 20*b* of parallel horizontal sides 11*a*. The top portion 21 of the blinds may be moved independently of the bottom portion 22 by providing separate thumb dials 12*a* and 12*b* and 13*a* and 13*b* on each side. A pair of transparent plastic or glass sheets 31 are mounted to the frame 11 on respective sides of the blinds 14 and 15 to protect the blinds 14, 15 from water and damage.

FIG. 1 features the adjustability of the blinds 14 and 15. The user can turn the thumb dials 12 and 13 to cause the blinds 14 and 15 to extend and thus minimize the landscape visible through invention 10. The user can also turn the thumb dials 12 and 13 to cause the blinds 14 and 15 to compress similar to an accordion, towards the parallel vertical sides 11*b*. This compression increases the landscape visible through invention 10. The golf ball 23 is shown as well as the hole 24 through aperture 30.

FIG. 2 discloses an alternate embodiment of the present invention wherein handle 18 is attached to the invention 10. This design permits one-handed use of the invention and facilitates storage in a golf bag or jacket. The blinds 14 and 15 may also be hand manipulated.

FIG. 1 illustrates the method by which the unit is used. In use, the golfer holds the invention 10 in front of his face so that he can view the landscape between and around the golf ball and the hole. Then, the golfer turns the thumb dials 12*a*, 12*b* and 13*a*, 13*b* to extend and/or compress the blinds 14 and 15 so that the desired amount of landscape in and around the golf ball and hole is viewable through the invention aperture 25. As shown in FIG. 1, the thumb dials 12*a* and 13*a* can be manipulated to provide a predetermined opening in the viewing aperture 30 along the base 22 of the blinds 14 and 15 while dials 12*b* and 13*b* narrow the opening 30 to zero in on the hole 24. This will allow the golfer to block out any visible distractions and focus in on determining the best path between the golf ball and the hole. The golfer's putt will, therefore, be aligned and the chances of a successful putt will increase.

A typical frame 11 measures 7" along member 11*a* and 5" along members 11*b* and is approximately ½ to 1" thick. The size is quite convenient to take on a round of golf and since the frame is plastic, the invention is light and easy to handle.

Further, the device 10 is not complicated and inexpensive. The main advantage, however, is the improvement in putting accuracy as described above.

While the invention has been explained by a detailed description of certain specific embodiments, it is understood that various modifications and substitutions can be made in any of them within the scope of the appended claims that are intended also to include equivalents of such embodiments.

What is claimed is:

1. A portable putting device for assisting a golfer to align a golf ball with a golf hole on a green and read the green comprising:

a substantially rectangular hand held frame having parallel end members and elongated parallel transverse members extending between the end members and a viewing aperture surrounded by said frame members and end member, and including continuous flexible blind mounted to each side member;

means for adjusting the opening in the viewing aperture by moving the flexible blinds; and;

means for controlling the adjusting means to provide a predetermined viewing aperture to line up the ball for putting to the hole and read the green surrounding the hole.

2. A putting device in accordance with claim 1, wherein:

the means for adjusting the viewing aperture includes a paper or plastic flexible continuous blind mounted to each end member and slidable along the elongated transverse members.

3. A putting device in accordance with claim 2, wherein:

the means for controlling the viewing aperture includes thread like flexible material that is mounted to each of the blinds for adjusting the viewing aperture with the blinds to provide the desired viewing area to align the golf ball with the hole.

4. A putting device in accordance with claim 1, wherein:

the means for controlling the adjusting means includes a pair of rotating thumb dials each pair being mounted on a separate side member and having the thread-like members attached thereto and mounted to the respective blinds to control the movement of said blinds, said blinds having an upper and lower portion each controlled independently by a thumb dial.

5. A putting device in accordance with claim 1, further including:

a handle mounted to one of the parallel elongated frame members and projecting outwardly therefrom for one-handed use of the device.

6. A putting device in accordance with claim 2 further including:

gripping portions projecting outwardly from each end member;

a transparent plastic sheet on each side of the blinds extending between the frame members to enclose the aperture and protect the frame members; and, grooves in the elongated transverse members engaged by the blinds for movement therealong.

7. A putting device in accordance with claim 2 wherein:

the blinds each include a main body end portion at each end.

8. A method to assist a golfer to align a putt and read the green surrounding a hole for a shot into the hole comprising the steps of:

providing a substantially rectangular portable hand held frame with an open internal viewing aperture;

placing the substantially rectangular frame with an open internal viewing aperture before the golfer's face and controlling the aperture to align the golf ball with the hole;

viewing the golf ball, the hole, and the surrounding green through the internal viewing area; and modifying the internal viewing aperture to narrow or enlarge the viewing area until the golf ball, hole, and surrounding green are isolated and the background area is blocked thereby aligning the putt and permitting reading of the green.

9. The method in accordance with claim 8 further including the steps of:

providing movable blinds within the viewing aperture; and providing rotating thumb dials mounted in the frame wherein said thumb dials, are coupled by thread-like material to the blinds, and adjusting the blinds by rotating the thumb dial.

* * * * *